US006107260A

United States Patent [19]

Sugita et al.

[11] Patent Number: 6,107,260

[45] Date of Patent: Aug. 22, 2000

[54] ALUMINIUM OR ALUMINIUM ALLOY MOULDING PROCESS LUBRICANT, AND ALUMINIUM OR ALUMINIUM ALLOY PLATE FOR MOULDING PROCESSES

[75] Inventors: Tomoyuki Sugita; Kuniaki Matsui, both of Maoka; Hideya Watada, Hatano, all of Japan

[73] Assignees: Castrol Kabushiki Kaisha; Shinkou Alcoa Yusoukizai Kabushiki Kaisha

[21] Appl. No.: 08/652,480

[22] PCT Filed: Dec. 22, 1994

[86] PCT No.: PCT/JP94/02204

§ 371 Date: Sep. 16, 1996

§ 102(e) Date: Sep. 16, 1996

[87] PCT Pub. No.: WO95/18202

PCT Pub. Date: Jul. 6, 1995

[30] Foreign Application Priority Data

Dec. 24, 1993 [JP] Japan ..... 5-348254

[51] Int. Cl.[7] ..... C10M 129/26

[52] U.S. Cl. ..... 508/539; 508/579; 72/42

[58] Field of Search ..... 508/539, 579, 508/532; 72/42; 428/461; C10M 173/03

[56] References Cited

U.S. PATENT DOCUMENTS

| | | | |
|---|---|---|---|
| 3,124,531 | 3/1964 | Whetzel | 508/579 |
| 3,277,001 | 10/1966 | Fischer | 508/539 |
| 3,536,622 | 10/1970 | Knecht | 508/532 |
| 3,847,828 | 11/1974 | Latos | 508/532 |
| 3,933,660 | 1/1976 | Tadenuma et al. | 508/532 |
| 4,027,512 | 6/1977 | Treat | 72/42 |
| 4,664,823 | 5/1987 | Kuwamoto et al. | 508/262 |
| 4,752,405 | 6/1988 | Kyle et al. | 508/532 |
| 5,171,903 | 12/1992 | Koyama et al. | 585/3 |

FOREIGN PATENT DOCUMENTS

| | | | |
|---|---|---|---|
| 660102 | 3/1963 | Canada . | |
| 0 073 306 | 3/1993 | European Pat. Off. | C10M 7/10 |
| 34-864 | 2/1959 | Japan . | |
| 54-3105 | 1/1979 | Japan . | |
| 58-38797 | 3/1983 | Japan . | |
| 1-153794 | 6/1989 | Japan . | |
| 4-20598 | 1/1992 | Japan . | |
| 4-173897 | 6/1992 | Japan . | |
| 4-189897 | 7/1992 | Japan . | |

*Primary Examiner*—Jacqueline V. Howard
*Assistant Examiner*—Cephia D. Toomer
*Attorney, Agent, or Firm*—Bacon & Thomas

[57] ABSTRACT

Lubricants are provided which are aluminium or aluminium alloy plate moulding lubricants, and are lubricants which are easily removed after moulding of aluminium or aluminium alloy plate and assembly; also, bonding and welding can be performed while coated with those lubricants, and the bonding and weld strength obtained are the same as if there were no adhering lubricant. Their main constituents are a polyalkylene oxide or derivative thereof and a higher fatty acid salt. It is preferable if they contain 50 to 2 weight % polyalkylene oxide or derivative thereof, and the ratio of higher fatty acid salt and polyalkylene oxide or derivative thereof is within the range 1/12 to 1/4, and further that they contain water. When these lubricants are formed into a 0.2–2.0 g/m$^2$ solid film on the surface of the aluminium or aluminium alloy plate, this is suitable for moulding processes.

14 Claims, No Drawings

ALUMINIUM OR ALUMINIUM ALLOY MOULDING PROCESS LUBRICANT, AND ALUMINIUM OR ALUMINIUM ALLOY PLATE FOR MOULDING PROCESSES

SPECIFICATION

This Application is a 371 of PCT/JP94/02204, Dec. 22, 1994.

Aluminium or aluminium alloy moulding process lubricant, and aluminium or aluminium alloy plate for moulding processes.

FIELD OF TECHNOLOGY

This invention concerns processing technology for aluminium or aluminium alloy plate (below, these are together referred to as Al). More specifically, this invention relates to a lubricant which is effective during the moulding of Al products of complex shape which are difficult to process, with Al components which are difficult to mould, for example automobile components, and also electrical equipment components, and aircraft components.

BACKGROUND TECHNOLOGY

Since Al has superior corrosion resistance and mouldability, as well as lightness, it is widely used in many industrial fields, particularly the automobile industry, as the most universally used metal material, after steel materials. Recently, in order to make automobiles lighter, the use of Al plate has gradually been increasing. However, Al plate is more difficult to mould than steel plate, and easily cracks during moulding; hence there are major problems, such as shape lmitations during design.

Because of this, when pressing Al plate, automobile manufacturers often use liquid lubricating oils or solid lubricants with superior lubricating properties rather than using the normal mineral oil lubricants. The solid lubricants are used to increase press mouldabuity by forming a lubricant film on the Al plate material beforehand. Thus, in the subsequent assembly steps, bonding processes and welding processes are performed on the pressed products without removing the lubricant, and the lubricant is removed in a degreasing step after completion of the assembly steps.

However, with the aforesaid method, because the bonding processes and welding processes are performed with the lubricant still coated on the product after pressing, the residual lubricant causes poor bonding and poor welding, and as a result productivity may decrease and product quality may deteriorate.

DISCLOSURE OF INVENTION

This invention is made in the light of circumstances such as the aforesaid. The purpose of this invention is to provide lubricants for Al plate moulding, which solve the defects of the previous technology, and also to provide Al plate for moulding processes. Thus, it provides Al plate moulding lubricants such that degreasing is not difficult when degreasing is performed after the moulding and assembly processes have been finished, and the same bonding strength, weld strength and spot electrode life are obtained as when no lubricant is adhering to the press-moulded product in the bonding process and welding process after the pressing process, and it provides Al plate for such moulding processes.

In order to achieve the aforesaid purpose, the present inventors carried out repeated research into Al plate moulding methods, and thus, as a result of searching for moulding process lubricant compositions that do not worsen the bondability and weldability of the Al plate, made this invention.

In one aspect, this invention provides an Al moulding process lubricant characterised in that it is an aqueous solution comprising a polyalkylene oxide or derivative thereof, a higher fatty acid salt and water, among these the polyalkylene oxide or derivative thereof comprises 2 to 50 weight %, and is contained in an amount 4 to 12 times the weight of the higher fatty acid salt, and it forms a solid lubricant film on evaporation of the water after coating onto the Al surface.

In another aspect, this invention provides an Al plate for moulding processes, characterised in that a lubricant containing 4–12 weight parts polyalkylene oxide or derivative thereof per weight part higher fatty acid salt is formed onto the surface of the Al plate as a 0.2–2.0 g/m$^2$ solid film.

The "moulding" referred to above does not only mean moulding by pressing alone, and it includes moulding by drawing or deep-drawing processes, stamping, and extrusion.

This invention is described in detail below.

The moulding lubricant concerned in this invention forms solid lubricating films and has the action of increasing lubrication during moulding processes such as press-moulding. Further, since the lubricant films formed by this lubricant have superior adhesion with bonding agents and conductivity when high currents are passed, and confer satisfactory bonding strength and weld strength in the assembly process, it is possible to restrict to a minimum poor bonding and poor welds formed as aforesaid because of lubricants. Also, this lubricant has good mouldability and degreasability, and causes no reduction in mouldability and degreasability compared to the lubricants previously used by automobile manufacturers.

Further, the Al plate for moulding processes concerned in this invention has a lubricant film formed by coating the aforesaid lubricant onto the Al plate surface. The lubricant film formed is superior in adhesion with bonding agents and in conductivity when high currents are passed, and confers satisfactory bonding strength and weld strength in the assembly process. Hence by means of this invention, the bondability and weldability can be improved, while maintaining the mouldability of the solid lubricant.

Next, defining factors for the lubricants of this invention are shown below.

As polyalkylene oxides or derivatives thereof, for example polyoxyethylene, oxyethylene oxypropylene (block) polymer, ethylene oxide propylene oxide (block) additive of ethylenediamine, polyoxyethylene stearyl ether, polyoxyethylene oleyl ether, polyoxyethylene cetyl ether, polyoxyethylene castor oil ether, polyoxyethylene stearate, polyoxyethylene oleate, polyoxyethylene laurate, etc., may be mentioned. Of course, they are not limited to these. Among them, polyoxyethylene and polyoxyethylene stearyl ether are preferably used. Also, polyalkylene oxides or derivatives thereof which are solid at normal temperature and of melting point 115° C. or below are preferable, and those of melting point 50–100° C. are especially desirable.

As higher fatty acid salts, for example sodium salts, potassium salts or other salts of stearic acid, palmitic acid, myristic acid, lauric acid, arachic acid, behenic acid, myristoleic acid, palmitoleic acid, oleic acid, linolic acid, linolenic acid, eleostearic acid, hydroxystearic acid, ricinolic acid, castor oil fatty acids, coconut oil fatty acids, beef tallow fatty acids, mutton tallow fatty acids, etc., may be mentioned. Of course, they are not limited to these. Also, as the lubricating properties of higher fatty acid salts vary depending on the number of carbons, it is preferable to use those with 8–24 carbons, and especially desirable to use those with 12–20 carbons.

Through the combined use of the aforesaid two components as the main constituents, improvements in adhesion of bonding agents with the lubricant, degreasability and weld strength, and improvements in mouldability and uniformity of welds, etc., are achieved.

Provided that these components are contained as the main constituents, other additives or diluents can be incorporated as appropriate. For example, when using diluted with water, the following composition is desirable.

That is to say, when using by diluting these main constituents in water, if the weight of polyalkylene oxide or derivative thereof is more than 50 weight %, the viscosity of the lubricant becomes too high, and has an adverse effect on workability when coating onto the Al plate. Conversely, with less than 2 weight %, a satisfactory lubricant film after drying is not obtained. Hence, when using diluted with water, 50 weight % or less and 2 weight % or more of the polyalkylene oxide or derivative thereof is preferable.

In this case, with a composition ratio of higher fatty acid salt and polyalkylene oxide or derivative thereof less than 1/12, a tendency is seen for the mouldability in the pressing process after coating onto the Al plate and drying to be insufficient; also, if the composition ratio is higher than 1/4, there tend to be adverse effects on degreasability in the assembly process. Hence it is desirable for the composition ratio of higher fatty acid salt and polyalkylene oxide or derivative thereof to be in the range 1/12 to 1/4. That is to say, it is desirable to use a 4–12 fold weight of the polyalkylene oxide or derivative thereof, per weight part of higher fatty acid salt.

Also, water acts as a diluent for polyalkylene oxides or derivatives thereof and higher fatty acid salts and evaporates into the atmosphere after coating. With diluents other than water, for example organic solvents, atmospheric pollution will be caused after evaporation. Consequently, it is desirable to use water as the diluent. Ordinary tap-water may be used as the water, but in order to prevent formation of insoluble salts it is preferable to use deionised water or distilled water.

There are no particular restrictions as to other additives, and depending on the purpose of use the following additives can be used. For example, antioxidants such as 2,6-di-t-butylparacresol, tetramethyldiaminodiphenylmethane and zinc dithiophosphate, anticorrosion agents such as dinonylnaphthalenesulphonates, phosphate esters, thiophosphate esters, α-mercaptostearic acid, benzoate salts and sorbitan monooleate, oiliness improvers such as higher fatty acids, higher alcohols, fatty acid esters and higher amines, extreme-pressure agents such as dibenzyl sulphide, chlorinated paraffins, triallyl phosphate, lead naphthenate and molybdenum isobutyl xanthate, and detergent dispersants such as naphthenate salts and calcium cetylphenate, etc., may be mentioned. These additives can be added up to 10% of the total contained weight of the polyalkylene oxide or derivatives thereof and higher fatty acid salts which are the main constituents. If that amount or more is added, caution is necessary since there is a risk that it will cause a decrease in degreasability.

Next, the reasons for the numerical limitations on the lubricant film when the aforesaid lubricant is coated onto Al plates are explained.

If the amount of lubricant film is greater than 2.0 g/m$^2$, the degreasing in the degreasing process after completion of the assembly process becomes incomplete and the lubricant is not completely removed, and causes poor painting in subsequent painting processes. Further, with less than 0.2 g/m$^2$, the mouldability during the pressing process is insufficient, causing cracking to occur. Consequently, the amount of solid lubricant film coating after drying is set in the range 0.2–2.0 g/m$^2$.

Also, the aforesaid lubricant is sometimes coated directly onto the surface of the Al plate for example by hot-melting, but for the sake of workability it is normally preferable to use it in such a way as to form a solid lubricant film by diluting with water, coating onto the Al plate for example with a roller-coater, and drying. When water is used, care should be taken since if the amount of solids is too great the viscosity becomes high and it cannot be coated with a roller-coater, and conversely if the amount of solids is too low a sufficient amount of lubricant film cannot be obtained after coating, and it is for example necessary to apply two coats, and either of these can cause a worsening in workability.

Also, when the aforesaid lubricants are used diluted with water, it becomes necessary to dry the lubricant, but there is no particular restriction on the drying method. For example, it can be dried by leaving at room temperature, but in terms of productivity it is desirable to dry it by blowing hot air.

Further, there is also no particular restriction as to the material quality of the Al plate which is the moulding material. The Al plate may be made of aluminium, and also may commonly be made of an aluminium alloy. As the Al plate, it is possible to use material with suitable components and composition selected on the basis of the requirements for the final product. For example, if a high-strength material is required, an Al/high-Mg (3–6% Mg) type can be used.

PRACTICAL EXAMPLES

Next, practical examples of this invention are presented.

Practical Example 1

Using the 8 different lubricant compositions No. 1 to No. 8 shown in table 1, 0.5 g/m$^2$ lubricant films were formed on test pieces by coating these onto the test pieces, then drying by keeping 5 minutes in a 70° C. thermostatic chamber. Further, those shown in No. 9 to No. 16 in table 1 are lubricants outside the range of this invention, but lubricant films were formed in the same way using these lubricants. Using the test pieces thus obtained, the mouldability during press-moulding, degreasability from the pressing process to the assembly process, bondability in the assembly process, weldability in the assembly process and workability when coating the lubricant were assessed. The test pieces and assessment methods used for this are as follows.

The tests were performed with n=3, and the mean values of these were taken; the lubricants were coated using a roller-coater. Further, if the lubricant had a high content of solids other than water, and coating was impossible as the viscosity was too high, it was coated (hot-melt) after lowering the viscosity by heating the lubricant. If the lubricant had a low solids content and it was impossible to coat the specified amount of solids in a single operation with the roller-coater, the coating with the roller-coater was performed twice.

A Test Pieces

JIS 5182-O material, of plate thickness 1 mm, was used.

B Lubricants

As shown in table 1, a total of 16 different lubricants, 8 different lubricants corresponding to the practical examples of this invention and 8 different lubricants outside this invention, were prepared and used.

TABLE 1

Constituents of Lubricant Test Samples

| No. | Lubricant Composition | Remarks |
|---|---|---|
| 1 | Polyoxyethylene 1.4% + sodium stearate 0.2% + water 98.4% | Examples of this Invention |
| 2 | Polyoxyethylene 7% + sodium stearate 1% + water 92% | |
| 3 | Polyoxyethylene 17.5% + sodium stearate 2.5% + water 80% | |
| 4 | Polyoxyethylene 52.5% + sodium stearate 7.5% + water 40% | |
| 5 | Polyoxyethylene 17.5% + sodium stearate 2.5% + naphthenic acid salt 1% + water 79% | |
| 6 | Polyoxyethylene stearate 17.5% + potassium stearate 2.5% + water 80% | |
| 7 | Polyoxyethylene oleyl ether 17.5% + potassium oleate 2.5% + water 80% | |
| 8 | Polyoxyethylene laurate 17.5% + potassium oleate 2.5% + water 80% | |
| 9 | Polyoxyethylene 15% + sodium stearate 5% + water 80% | Comparative Examples |
| 10 | Polyoxyethylene 18.75% + sodium stearate 1.25% + water 80% | |
| 11 | Polyoxyethylene 20% + water 80% | |
| 12 | Oxyethylene oxypropylene block copolymer 20% + water 80% | |
| 13 | Polyoxyethylene stearate 20% + water 80% | |
| 14 | Potassium stearate 10% + water 90% | |
| 15 | Sodium oleate 20% + water 80% | |
| 16 | Hardened animal wax 17% + surfactant 3% + water 80% | |

C Assessment Methods (1) Mouldability

Using an Erichsen tester, the following square tube drawing test was performed, with assessment on the basis of the maximum moulding height before cracks occurred.

Blank diameter: □ 100 mm

Punch diameter: □ 40 mm square head (punch R 4.5 mm, die R 3.0 mm)

Process speed: 20 mmimin

Assessment criteria: ○ 10.0 mm or more
Δ less than 10.0 mm, 9.0 mm or more
X less than 9.0 mm.

(2) Degreasability

After immersing for 2 minutes in alkaline sodium silicate type degreasing liquid (pH=10.5, 430° C.±2° C.), assessment was by the percentage area wetted by water after removing and water washing.

Assessment criteria: ○ 80% or more
Δ less than 80%, 50% or more
X less than 50%.

(3) Bondability

Using a commercial epoxy structure adhesive, the tests were performed on the basis of the adhesive tensile shear test method specified in JIS K6850.

Assessment criteria: ○ 1500 N/cm$^2$ or more
Δ 1400 N/cm$^2$ or more, less than 1500 N/cm$^2$
X less than 1400 N/cm$^2$.

(4) Weldability

Continuous spot testing during spot-welding was performed. The strength at the time of the spot was based on the test method of JIS Z 3136, and assessment was based on the number of continuous spot-welded spots until the time when the strength reached 1500 N or less.

Assessment criteria: ○ 300 spots or more
Δ less than 300 spots, 160 spots or more
X less than 160 spots.

(5) Workability

If coating was possible using the roller-coater once, the workability was regarded as good (○), and if it was impossible with one coating, and hot-melting or two coatings were performed, the workability was regarded as unsatisfactory (Δ).

The results of the assessments of mouldability, degreasability, bondability, weldability and workability in the practical examples and comparative examples were as shown in table 2. In the comparative examples, where the lubricants Nos. 9–16 of table 1 were used, because the lubricant compositions are outside the range specified in this invention, there were defects in that one or more of mouldability, degreasability, bondability and weldability were inferior.

In contrast to this, in the practical examples, where the lubricants Nos. 1–8 of table 1 were used, a balance of mouldability, degreasability, bondability and weldability is obtained. This is due to the fact that the composition ratio of polyoxyethylene and sodium stearate in the lubricants is within the range ¼ to 1/12. Now, with the aforesaid composition ratio ¼ or more as in comparative example 9, the degreasability decreases, and with 1/12 or less as in comparative example 10, there is a tendency for the mouldability and bondability to decrease.

Practical Example 2

Using the lubricant shown as No. 3 in table 1, the amounts coated onto the same test pieces as were used in practical example 1 were varied, and the mouldability and degreasability of the test pieces were investigated. That is to say, as a result of varying the amount of solid lubricant coating as shown in table 3, the mouldability and degreasability results shown in table 3 were obtained.

TABLE 2

| Performance of Test Lubricants | | | | | | | | | | | |
|---|---|---|---|---|---|---|---|---|---|---|---|
| | Mouldability | | | | Bondability | | Weldability | | | | |
| | Square Tube | | Degreasing Ability | | Shear | | Number of | | Workability | | |
| Lubricant No. | Drawing Height (mm) | Assess-ment | Wet Area (%) | Assess-ment | Strength (N/cm$^2$) | Assess-ment | Continuous Spots (Spots) | Assess-ment | Coating Method | Assess-ment | Remarks |
| 1 | 10.9 | ○ | 100 | ○ | 1650 | ○ | 560 | ○ | Roller-coater, 2 coats | Δ | Examples |
| 2 | 10.9 | ○ | 100 | ○ | 1650 | ○ | 560 | ○ | Roller-coater | ○ | of this |
| 3 | 10.8 | ○ | 90 | ○ | 1650 | ○ | 500 | ○ | Roller-coater | ○ | Invention |
| 4 | 10.9 | ○ | 90 | ○ | 1650 | ○ | 640 | ○ | Hot melt | Δ | |
| 5 | 10.7 | ○ | 85 | ○ | 1600 | ○ | 700 | ○ | Roller-coater | ○ | |
| 6 | 10.4 | ○ | 85 | ○ | 1530 | ○ | 500 | ○ | Roller-coater | ○ | |
| 7 | 10.2 | ○ | 85 | ○ | 1600 | ○ | 700 | ○ | Roller-coater | ○ | |
| 8 | 10.3 | ○ | 85 | ○ | 1530 | ○ | 500 | ○ | Roller-coater | ○ | |
| 9 | 11.3 | ○ | 60 | Δ | 1600 | ○ | 200 | Δ | Roller-coater | ○ | Comparative |
| 10 | 9.4 | Δ | 100 | ○ | 1450 | Δ | 660 | ○ | Roller-coater | ○ | Examples |
| 11 | 8.7 | X | 100 | ○ | 1790 | ○ | 380 | ○ | Roller-coater | ○ | |
| 12 | 9.7 | Δ | 70 | Δ | 1810 | ○ | 120 | X | Roller-coater | ○ | |
| 13 | 9.2 | Δ | 95 | ○ | 1710 | ○ | 100 | X | Roller-coater | ○ | |
| 14 | 11.4 | ○ | 30 | X | 1150 | X | 80 | X | Roller-coater | ○ | |
| 15 | 11.5 | ○ | 20 | X | 1320 | X | 100 | X | Roller-coater | ○ | |
| 16 | 12.1 | ○ | 0 | X | 330 | X | 40 | X | Roller-coater | ○ | |

TABLE 3

| Relationship Between Amount of Coating Lubricant and Mouldability/Degreasing Ability | | | | | | |
|---|---|---|---|---|---|---|
| | Coating Amount of | Mouldability | | Degreasing Ability | | |
| No. | Solid Lubricant (g/m$^2$) | Square Tube Drawing Height (mm) | Assess-ment | Wet Area (%) | Assess-ment | Remarks |
| 1 | 0.1 | 8.9 | X | 100 | ○ | Comparative Example |
| 2 | 0.5 | 10.8 | ○ | 90 | ○ | Example of this Invention |
| 3 | 1.0 | 12.4 | ○ | 80 | ○ | Example of this Invention |
| 4 | 2.5 | 15.0 | ○ | 20 | X | Comparative Example |

The results were that in the comparative example test No. 1 in table 3, the mouldability was poor since the amount of coating was low, and in the comparative example test No. 4, the degreasability was poor since the amount of coating was large. In contrast to this, in the practical example tests No. 2 and No. 3, the result was that both mouldabllity and degreasability were superior since the amount of coating was correct.

Since, as explained in detail above, through this invention good mouldability is achieved for Al, and moulding becomes possible even into shapes for which press-processing was previously difficult, and also it becomes possible to improve the degreasability, bondability and weldability after moulding, there are very significant benefits which will contribute to the broadening of the applications for Al plate.

APPENDIX A

Lubricant No. 1:

Lubricant composition having less than 2%, by weight, polyalkylene oxide Workability deficient (Δ).

Lubricant No. 4:

Lubricant composition having greater than 50%, by weight, polyalkylene oxide Workability deficient (Δ).

Lubricant No. 9:

Lubricant composition having polyalkylene oxide in an amount less than 4 to 12 times the weight of the higher fatty acid salt.

Decreasing ability deficient (Δ).

Workability deficient (Δ).

Lubricant No. 10:

Lubricant composition having polyalkylene oxide in an amount greater than 4 to 12 times the weight of the higher fatty acid salt.

Moldability deficient (Δ).

Bondability deficient (Δ).

Lubricant No. 11:

Lubricant composition without higher fatty acid salt.

Moldability deficient (X).

Lubricant No. 12:

Lubricant composition without polyalkylene oxide and higher fatty acid salt.

Moldability deficient (Δ).

Decreasing ability deficient (Δ).

Weldability deficient (X).

Workability deficient (Δ).

Lubricant No. 13:

Lubricant composition without a polyalkylene oxide and a higher fatty acid salt.

Moldability deficient (Δ).

Weldability deficient (X).

Lubricant Nos. 14–16:

Lubricant compositions without a polyalkylene oxide.

Decreasing ability deficient (X).

Bondability deficient (X).

Weldability deficient (X).

What is claimed is:

1. Aluminium or aluminium alloy moulding process lubricant comprising an aqueous solution of a polyalkylene oxide or derivative thereof, a higher fatty acid salt and water, wherein the polyalkylene oxide or derivative thereof comprises 2 to 50 weight % of the lubricant, and is contained in an amount 4 to 12 times the weight of the higher fatty acid salt, said solution forming a solid lubricant film on evaporation of the water after coating onto an aluminium or aluminium alloy surface.

2. Aluminium or aluminium alloy plate for moulding processes, comprising an aluminium or aluminium alloy plate and a lubricant containing 4–12 weight parts polyalkylene oxide or derivative thereof per weight part higher fatty acid salt on the surface thereof as a 0.2–2.0 $g/m^2$ solid film.

3. The lubricant according to claim 2, wherein said polyalkylene oxide or derivative thereof is a solid at room temperature and has a melting point of 115° C. or below.

4. The lubricant according to claim 3, wherein said polyalkylene oxide or derivative thereof has a melting point of 50–100° C.

5. The lubricant according to claim 2, wherein said polyalkylene oxide or derivative thereof is polyoxyethylene or polyoxyethylene stearyl ether.

6. The lubricant according to claims 2, wherein said higher fatty acid salt contains from 8–24 carbon atoms.

7. The lubricant according to claim 6, wherein said higher fatty acid salt contains from 12–20 carbon atoms.

8. The lubricant according to claim 2 wherein said water is deionized or distilled water.

9. The lubricant according to claim 2, further comprising up to 10% by weight of the total combined weight of the polyalkylene oxide or derivatives thereof and higher fatty acid salts, of additives selected from the group consisting of anti-oxidants, anticorrosive agents, oiliness improvers, extreme pressure agents, detergent dispersants and mixtures thereof.

10. The lubricant according to claim 9, wherein said anti-oxidants are selected from the group consisting of 2,6-di-t-butylparacresol, tetramethyldiaminodiphenyl methane, and zinc dithiophosphate.

11. The lubricant according to claim 9, wherein said anti-corrosion agents are selected from the group consisting of dinonylnaphthalenesulphonates, phosphate esters, thiophosphate esters, α-mercaptostearic acid, benzoate salts and sorbitan monooleate.

12. The lubricant according to claim 9, wherein said oiliness improvers are selected from the group consisting of higher fatty acids, higher alcohols, fatty acid esters and higher amines.

13. The lubricant according to claim 9, wherein said extreme-pressure agents are selected from the group consisting of dibenzyl sulphide, chlorinated paraffins, trialkyl phosphate, lead naphthenate and molybdenum isobutyl xanthate.

14. The lubricant according to claim 9, wherein said detergent dispersants are selected from the group consisting of naphthenate salts and calcium cetylphenate.

* * * * *